United States Patent [19]

Smith

[11] Patent Number: 4,976,213

[45] Date of Patent: Dec. 11, 1990

[54] SECURING TUBES IN INFLATABLE BOATS

[75] Inventor: Norman C. Smith, Carisbrooke, England

[73] Assignee: Galt Composites Limited, Melksham, England

[21] Appl. No.: 341,208

[22] Filed: Apr. 21, 1989

[30] Foreign Application Priority Data

Apr. 22, 1988 [GB] United Kingdom ..... 8809556

[51] Int. Cl.[5] ..... B63B 7/00

[52] U.S. Cl. ..... 114/345

[58] Field of Search ..... 114/345; 441/40

[56] References Cited

U.S. PATENT DOCUMENTS 3,261,038 7/1966 Klepper ..... 114/345
3,473,502 10/1969 Wittkamp ..... 441/40
4,628,854 12/1986 Harding ..... 114/345

FOREIGN PATENT DOCUMENTS 2162131 1/1986 United Kingdom ..... 114/345
2171652 9/1986 United Kingdom ..... 114/345

*Primary Examiner*—Sherman Basinger
*Assistant Examiner*—Thomas J. Brahan
*Attorney, Agent, or Firm*—Cushman, Darby & Cushman

[57] ABSTRACT

A rigid hull inflatable boat has its buoyancy tube releasably secured to its hull by toggle stop means such as a three-bar buckle borne on flexible tags attached to the tube which is rotatable so as either to be passable through apertures in the hull or to engage the hull and prevent such passage. Inflation of the tube causes positive urging of the stop means towards such engagement.

8 Claims, 2 Drawing Sheets

SECURING TUBES IN INFLATABLE BOATS

FIELD OF THE INVENTION

Figure 1:
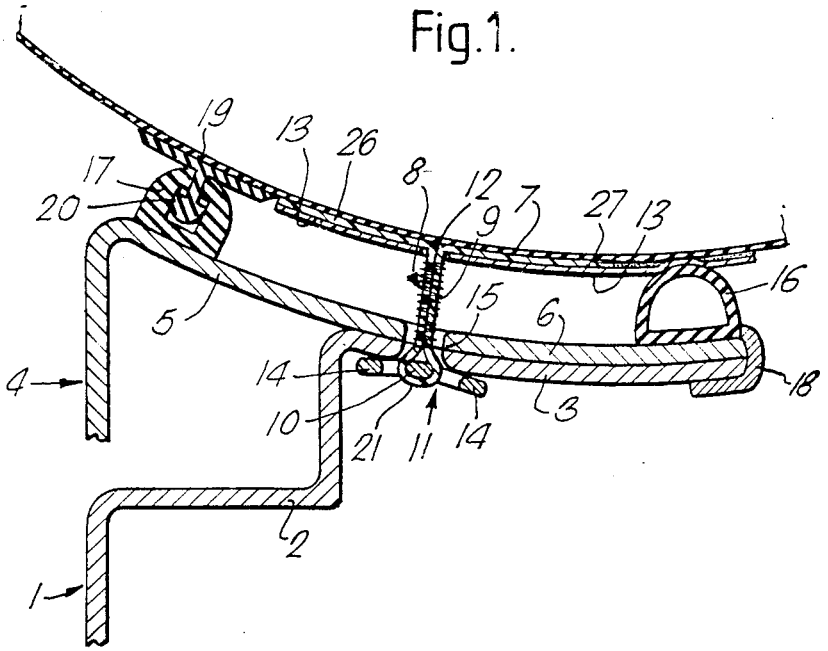

This invention relates t securing tubes in rigid-hull inflatable boats.

BACKGROUND OF THE INVENTION

It is concerned to improve and simplify the securing of the tube or tubes of the boat and also their ready release. If there has been a puncture or other failure of the tube, it is highly desirable that a replacement can be fitted quickly and without the need for workshop facilities.

SUMMARY OF THE INVENTION

In the present invention, a buoyancy tube of an inflatable boat is attached to the rigid hull of the boat by passing a free end of a tag the other end of which is attached to the tube through an aperture in the hull and preventing withdrawal of the free end. The prevention can be done by attaching a stop to the tag or more preferably by having a stop as a permanent part of the tag, the condition of the stop being changeable from one in which it can pass through the aperture to one in which it cannot, in the manner of a toggle.

Removal of a removable stop or a reverse change in the condition of a permanently-attached changeable one will allow the tube to be released from the hull.

The formation of the hull and of the tube will preferably interact in such a way that when the tube is inflated, the region of the tube nearest to the aperture is spaced from the aperture; the tag is arranged to be of such a length that when the tube is inflated the stop is drawn up to the surface of the hull. Then, accidental dislodgement or change in condition of the stop can be virtually ruled out for as long as the tube remains inflated. Upon deflation, however, the region of the tube will be able to be pulled towards the aperture to expose on the other side of the aperture enough length of the tag to allow removal or change in condition of the stop, so that the tag's free end can then be passed back through the aperture to release the tube from the hull.

A preferred form of toggle stop is a three-bar buckle of which the middle bar is permanently secured to the tag. The first condition of this buckle is one where it is pivoted about the middle bar to lie generally along the direction of the tag; its second condition is extending tranversely of that direction so that the two outer bars can react against the hull at respective sides of the aperture. The middle bar is preferably set to one side of a plane common to the outer two so that the middle bar may be drawn back towards the aperture further than the outer two.

The tag is preferably flexible and formed of reinforced elastomer, in a T-section with the head of the T bonded to the tube and the stop fitted through a loop formed at the foot of the leg of the T. The formation of the hull and of the tube whereby spacing of the latter from the aperture when the tube is inflated, may be achieved by providing an abutment on the hull surface at one or both sides of the aperture and this or one of these abutments may be a seal to prevent water passing inboard of it. If only one of the abutments is a seal then that will be on the inboard side of the aperture. A preferred form for an abutment on the outboard side of the aperture is a rubber buffer which is upstanding from the hull surface in which the aperture is formed and which may be extended over the edge of that surface to an outer surface of the hull so as to protect that edge and outer surface.

Figure 2:
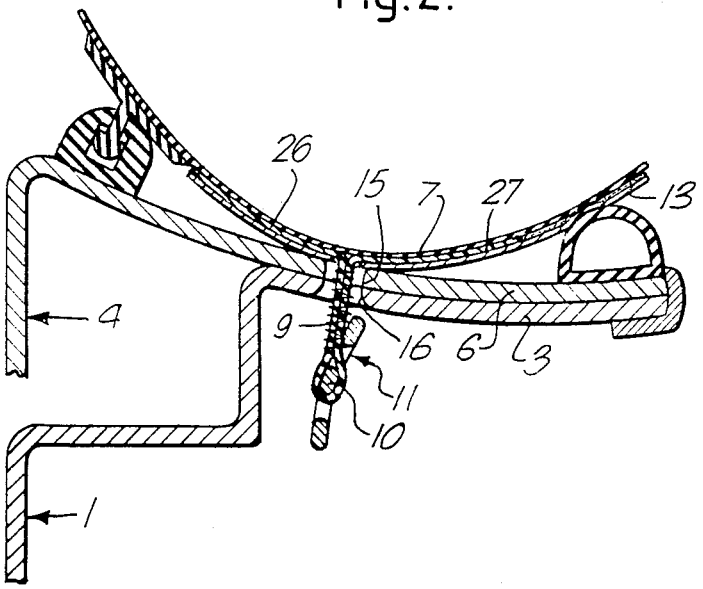
Figure 4:
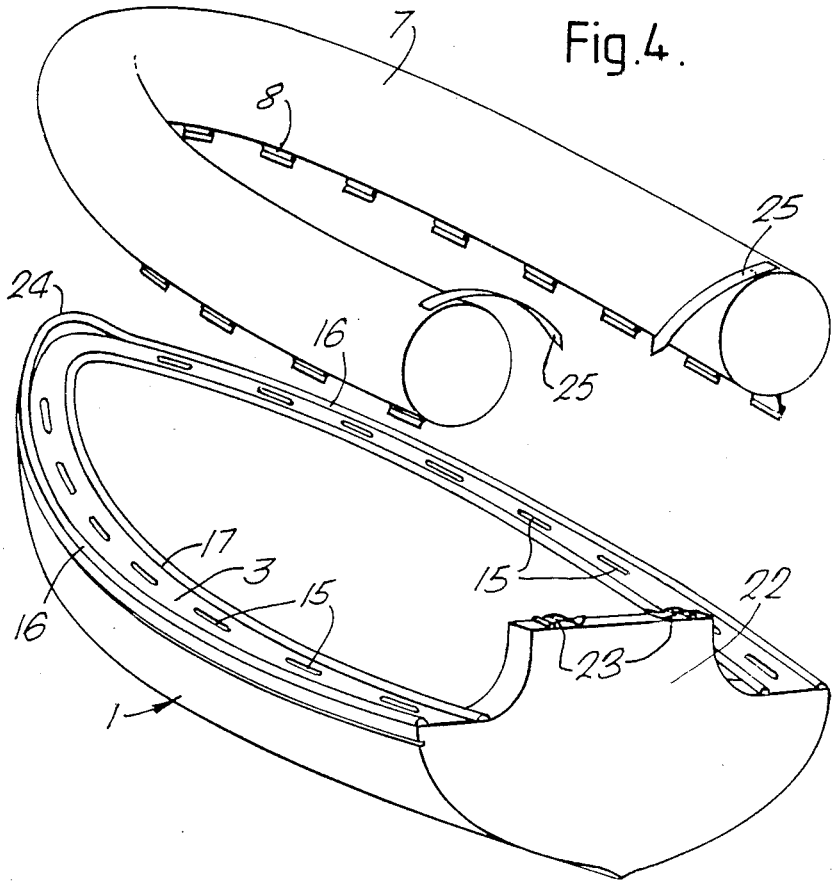
Figure 3:
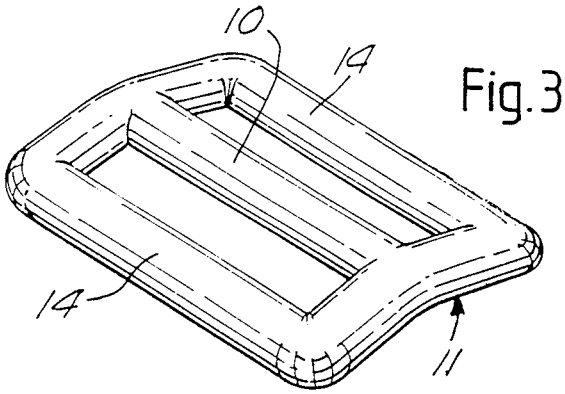

A particular embodiment of the invention may be described with reference to the accompanying drawings wherein:

FIG. 1 is a partial section through a buoyancy tube and hull flange, with the buoyancy tube in inflated condition, FIG. 2 is a similar section but with the buoyancy tube deflated, FIG. 3 is a perspective view of a three-bar buckle, and FIG. 4 is a perspective view of the hull with the tube removed.

In FIG. 1 we see a section through a flange portion of a rigid hull on an inflatable boat. The hull proper 1 is moulded to form a box section 2 at the gunwhale portion of the boat and then an outwardly projecting flange 3. A deck moulding 4 extends upwardly and inwardly above the box section 2 at 5 and then outwardly at 6 to be bonded to the flange part 3. So much is conventional.

One or more buoyancy tubes is attached to the rigid hull. The invention is concerned with the means of attachment and particularly with providing such means which ar secure under operating conditions and yet readily releasable at will by the operator.

The buoyancy tube 7 has flexible tags B attached along its base at appropriate intervals. These are formed from reinforced elastomeric material in a T-shape. The leg 9 of the T is formed by a portion of the material which has been doubled back to offer a loop which is to receive a stop means. In this case it receives the central bar 10 of a three-bar buckle 11. The head of the T is a single layer 26,27 of the elastomeric material bonded to the outer surface of the buoyancy tube. The double thickness leg 9 is both bonded and stitched, the stitching 12 extending as close as possible to the position of attachment to the buoyancy tube.

So as additionally to secure the tag to the tube and distribute loads upon the tags, a doubler sheet 13 is overlaid over the parts 26 and 27 extending longitudinally along a plurality of the tags.

The buckle 11 is better seen in FIG. 3. It has three parallel bars, the central bar 10 and outer bars 14. Preferably the three bars are not in a common plane but the centre bar 10 is offset from the common plane at the bars 14 in a direction towards the head of the T.

At intervals along the flanges 3,6 corresponding to the positioning of tags B apertures 15 are formed in those flanges.

The apertures are preferably machined out of the flanges after they have been bonded together, and have rounded corners in cross-section, as best seen from FIG. 3.

The buckle acts as a toggle in securing the tube to the hull.

The transverse dimension of the aperture is such that when the three-bar buckle is "flattened" up against the stem or the leg 9 of the tag it can pass through the aperture. This condition is seen in FIG. 2. But when as seen in FIG. 1 the three-bar buckle extends generally transversely of the direction of the tag then of course its lateral dimension is much greater than that of the aperture and it cannot pass through.

The conformation of the hull and tube is such that the tube portion nearest to the aperture is, when the tube is inflated, spaced away from the hull surface 6 and indeed is spaced away by a distance equal to the available length of the tag 8. This is achieved by providing one or more spacers on the hull and in this embodiment these are in the shape of elastomer profiles 16,17 outboard and inboard respectively from the aperture. The profile 16 is a simple cushion section bonded by its base to the surface 6. It may be extended to an outer surface of the hull as indicated at 18 to cover over the extreme edge of the flange structure 3,6.

The spacer 17 is shown in this embodiment as a hollow channel section, the mouth of the channel being narrower than its base portion, being designed to interfit with a T-section seal member 19 bonded to the tube 7. An enlarged head 20 of the free end of the leg of the T can pass through the restricted mouth of the channel by distortion of the material 17 and engage in the enlarged base portion. In this way a substantially watertight seal is provided at the inboard side of the aperture 15.

To assemble the tube to the hull, the tube is placed in deflated condition over the flanges 3,6. The toggle buckles 11 are put into their "flattened" condition and are fed individually through the respective apertures 15 and, as can be seen, the length of each tag 8 is enough to allow for the buckle to go free underneath each flange in that condition. The buckles are then rotated to extend at an angle to the tag.

The T-section seal 19 is forced into the channel 17 progressively as each tag is fitted. When each tag on a tube length has been fitted, that tube is inflated and this has the effect of drawing the tag away from the aperture upwardly and applying the two side bars 14 of the buckle against the undersurface of the flange 3 of the hull. For so long as the tube is inflated the buckle cannot shift.

If however there is deflation it is a matter of only a few minutes for tags to be drawn downwardly to the position seen in FIG. 2 and for the buckles to be turned and pushed upwardly through the aperture 15 to release the tube. This is assisted by the accessibility of the buckles from the outside of the boat. The head 20 of the T-section seal 19 can be simply pulled directly out of the mouth of the channel 17.

The angled conformation of the three-bar buckle is adopted so that the lowermost point 21 of the reinforced elastomer forming the tag will lie above the lowest common plane of the two side bars 14. Then, these bars will protect that material against chafe or wear if there should be any rubbing contact under the hull flange 3. Chafe through the aperture is minimised by the rounding of the surfaces of the edges of the buckle and the smooth finishing of the interior face of the aperture. The doubler 13 is extended outboard of the position of contact of the spacer 16 so as to provide additional chafe resistance of that position.

At the transom 22 of the boat the tube may additionally be secured by being clipped by straps 25 to anchor points 23 on the top of the transom, and at the bow 24 of the boat the tube may be additionally secured by having underneath its apex portion a pocket into which the extreme forward portion of the flange 3,6 at the bow is inserted as the tube is fitted.

In the embodiment just described the stop formed by the three-bar buckle 11 has formed a permanent part of the tube assembly by being bonded and sewn into the tag. In an alternative which is less preferred the formation of the tag may be preserved but its loop occupied in the first embodiment by the middle bar 10 of the buckle may be left unoccupied until such time as the tag has been passed through the aperture. Then, an enlarging pin may be passed through it to cause that end to increase in lateral dimension to an extent that it cannot pass back through the aperture and/or itself to abut against the undersurface of the flange. As can be seen, although the pin could be adequately secured in position when in use, this embodiment would be less desirable because of the danger that when not in use the pin would become mislaid and therefore not available when it was wanted.

I claim:

1. A rigid hull inflatable boat comprising:

a rigid hull;

a flange at gunwhale portions of the hull, said flange projecting laterally form said gunwhale portions and having a first face and a second face;

a plurality of apertures through said flange for communicating between said first face and said second face, said apertures being spaced individually along the length of said flange such that in a given length segment of the flange there is positioned only a single aperture;

an inflatable buoyancy tube;

a plurality of securing means positioned along said tube to correspond with said apertures for releasably securing said tube to said flange;

each of said securing means including a single flexible tag attached to said tube and stop means attached to said flexible tag for engaging said flange;

said stop means and said tag being adapted to pass through said aperture in said flange, said stop means being movable to engage said second face adjacent said aperture whereby said tube is secured above said first face of said flange with said stop means being beyond said second face of said flange; and a length of said tag and said stop means in relation to a distance between said second face and said tube being such that in an inflated state of said tube, said tube urges said tag away from said second face in a direction substantially perpendicular to said flange and said stop means into engagement with said second face.

2. A rigid hull inflatable boat according to claim 1 wherein the flexible tags are formed from reinforced elastomeric material with end portions attached to the tube and a double-back middle portion projecting therefrom to form the tag portion passing through the aperture, the double-back portion offering at a free end remote form the said end portions a loop for reception of the stop means.

3. A rigid hull inflatable boat according to claim 1 wherein the change of attitude is afforded by a rotatable engagement of the stop means with the tag.

4. A rigid hull inflatable boat according to claim 3 wherein the stop means is a buckle with three parallel bars, a centre bar of said three parallel bars engaging the tag and the outer bars of said three parallel bars forming the abutment with the hull.

5. A rigid hull inflatable boat according to claim 4 wherein the centre bar is offset from a plane common to the outer bars being closer to said tube than the said common plane, when the buckle is in its hull-abutting attitude.

6. A rigid hull inflatable boat according to claim 1 wherein the tube is spaced from the said first surface by spacer profiles disposed lengthwise along the hull, one inboard and one outboard of the apertures.

7. A rigid hull inflatable boat according to claim 6 wherein at least the inboard profile comprises a seal with the tube.

8. A method of releasably securing an inflatable buoyancy tube to the hull of a rigid inflatable boat comprising the steps of:

in a deflated condition of the tube, passing free ends of individual flexible tags permanently attached along the length of the tube through respective apertures in a flange projecting from gunwhale portions of the hull whereby the tube is positioned at one face of the flange and the free ends of the tags at a second face of said flange opposite to said one face, altering the attitude of stop means permanently attached at said free ends for engaging said flange so that said stop means cannot repass through said apertures, and inflating said tube, thereby drawing said tag through said aperture in a direction substantially perpendicular to said flange and engage said stop mean against said second face of said flange adjacent said aperture.

* * * * *